US005431318A

United States Patent [19]

Garcia

[11] Patent Number: 5,431,318

[45] Date of Patent: Jul. 11, 1995

[54] BALLISTIC PANEL CARRIER HAVING POCKET FOR BACKUP GUN

[76] Inventor: Randy A. Garcia, 10916 Townley Dr., Whittier, Calif. 90606

[21] Appl. No.: 100,123

[22] Filed: Jul. 30, 1993

[51] Int. Cl.[6] ..... F41C 33/00; F41H 1/02

[52] U.S. Cl. ..... 224/192; 224/215; 224/224; 224/911; 224/912; 2/2.5

[58] Field of Search ..... 224/206, 191, 202, 229, 224/230, 243, 911, 912, 211, 215, 198, 192; 2/2.5, 94, 247-254, 102

[56] References Cited

U.S. PATENT DOCUMENTS

| | | | |
|---|---|---|---|
| 2,517,615 | 8/1950 | Webster et al. . | |
| 2,640,987 | 6/1953 | Ehlers | 2/2.5 |
| 2,743,446 | 5/1956 | Persico et al. | 2/2.5 |
| 2,747,190 | 5/1956 | Foster . | |
| 2,748,391 | 6/1956 | Lewis, Jr. et al. . | |
| 2,954,563 | 10/1960 | Grazia . | |
| 3,452,362 | 7/1969 | Korolick et al. | 2/2.5 |
| 3,473,712 | 10/1969 | Genchi | 224/236 |
| 3,803,639 | 4/1974 | Cohen | 2/2.5 |
| 3,843,969 | 10/1974 | George et al. | 2/2.5 |
| 4,262,832 | 4/1981 | Perkins | 224/191 |
| 4,387,523 | 6/1983 | Gallagher | 42/1 J |
| 4,466,135 | 8/1984 | Coppage, Jr. | 2/2.5 |
| 4,497,069 | 2/1985 | Braunhut | 2/2.5 |
| 4,697,285 | 10/1987 | Sylvester | 2/2.5 |
| 4,774,724 | 10/1988 | Sacks | 2/2.5 |
| 4,877,131 | 10/1989 | Patros et al. | 224/911 |
| 4,966,320 | 10/1990 | DeSantis et al. | 224/911 |
| 5,002,214 | 3/1991 | Caranci | 224/228 |
| 5,008,959 | 4/1991 | Coppage, Jr. et al. | 2/2.5 |
| 5,060,314 | 10/1991 | Lewis . | |
| 5,073,985 | 12/1991 | Stone et al. . | |
| 5,157,792 | 10/1992 | Allen et al. . | |
| 5,327,811 | 7/1994 | Price et al. | 2/2.5 |

FOREIGN PATENT DOCUMENTS

| | | | |
|---|---|---|---|
| 9787 | of 1910 | United Kingdom | 224/911 |

*Primary Examiner*—Henry J. Recla
*Assistant Examiner*—Gregory M. Vidovich
*Attorney, Agent, or Firm*—Graham & James

[57] ABSTRACT

A ballistic panel carrier having a pocket for carrying a backup gun is provided. The carrier includes a cover having front and back carrying compartments to contain the front and back torso panels of a ballistic fabric material, respectively. Adjustable shoulder straps connect the front and back carrying compartments together at an upper portion thereof, and adjustable side straps connect the front and back carrying compartments together at side portions thereof. The pocket is accessible from an exposed portion of the front carrying compartment having a space capable of receiving a handgun, and a flap to seal the pocket and conceal the handgun within the pocket. The pocket may additionally have an internal holster capable of receiving a barrel of the handgun. A trauma plate may be inserted into the front carrying compartment behind the pocket to provide additional safety to the wearer.

11 Claims, 2 Drawing Sheets

BALLISTIC PANEL CARRIER HAVING POCKET FOR BACKUP GUN

BACKGROUND OF THE INVENTION

1. Field of the Invention

The present invention relates to protective body armor for use by law enforcement personnel, and more particularly, to a ballistic panel carrier having a pocket for concealing a backup handgun.

2. Description of Related Art

In today's dangerous climate, law enforcement personnel must take special precautions to protect their safety. One such safety precaution commonly relied upon by many law enforcement officers is the wearing of an armored garment, often referred to as a "bullet proof vest." These vests typically comprise panels formed of a ballistic fabric material, such as KEVLAR, which is especially resistant to puncturing by projectiles including bullets, as well as from knives. Despite its high puncture resistivity, the vests are also remarkably lightweight so as to be worn without unnecessarily encumbering the wearer. A bullet proof vest provides a law enforcement officer with an extra level of security against injury from an armed assailant.

These vests typically include belts or straps which permit the panels to be directly secured to the wearer. The vest panels have a shape intended to protect the vital areas of an officer's upper torso, and the straps can be adjusted to roughly fit each particular wearer. Normally, the vest would be worn beneath the wearer's uniform shirt as an undergarment. This way, the vest is concealed from view, and an assailant would not know of its existence and be tempted to test its effectiveness.

However, the general shape of the vests do not always accommodate the unique shapes and sizes of each particular wearer. Another disadvantage with the vests is the rough texture of the ballistic fabric material, which is uncomfortable if placed directly in contact with the officer's skin. Yet another notable problem with the poor fitting standard vests is their tendency to "ride up" the torso of the wearer, often dangerously exposing the officer's midriff section. Some officers overcome these problems by having custom carriers for containing the ballistic panels made which provide a more comfortable fit. The custom carriers can also be color coordinated to match the wearer's uniform and improve the concealability of the vest. An obvious drawback with this solution is the cost and difficulty of custom tailoring the carriers for each individual officer. Given the budget constraints currently faced by the law enforcement community, many such officers may be forced to sacrifice their personal safety and comfort in order to save costs.

Another safety precaution commonly employed by law enforcement personnel is the use of a backup handgun. While it is essential for law enforcement officers to carry a primary handgun in an external holster, it is additionally common for such officers to carry a second gun which is concealed from view. This second gun can be crucial in certain emergency circumstances, such as where the primary gun has become inoperable, lost, or has expended its supply of ammunition. In the worst case scenario, the primary gun may fall into the hands of the assailant, significantly compromising the security of the officer and other innocent bystanders. If the officer is equipped with a second or backup gun, the officer would have the opportunity to defend himself against such an assailant and to resolve the emergency situation.

A practical difficulty with the use of a backup gun is the problem in concealing the gun. Many officers carry the backup gun in a pocket, such as a side trousers pocket. For example, if the officer is right-handed, the backup gun may be kept in the left pocket so that it can be accessed by the officer's free hand (assuming the officer's right hand is engaged with the assailant, is disabled or is otherwise encumbered). However, carrying the backup gun in a trousers pocket creates certain difficulties in rapidly accessing the gun. When the officer is in a seated position, the gun cannot be readily removed from the pocket. Alternatively, if the officer's free hand is engaged, it is very difficult to remove the backup gun from the pocket with the opposite hand. In such situations, the officer may be powerless to use the backup gun against the assailant. An additional problem caused by carrying the backup gun in a trousers pocket is that the gun tends to wear the material of the pocket, frequently forming holes in the bottom of the pocket. Moreover, the trousers are not very effective in concealing the gun, and by giving away the shape of the gun the assailant can be alerted to the existence of the gun.

Accordingly, it would be desirable to provide an overall safety enhancing apparatus for use by law enforcement personnel which combines the beneficial aspects of the prior art, while overcoming these known deficiencies. Such a safety enhancing apparatus would enable a law enforcement officer to conceal a backup gun so that it is readily accessible for use during an emergency situation, while also providing a comfortable ballistic panel carrier.

SUMMARY OF THE INVENTION

In accordance with the teachings of this invention, a ballistic panel carrier having a pocket for carrying a backup gun is provided. The carrier includes front and back carrying compartments to contain front and back torso panels of a ballistic fabric material, respectively. Adjustable shoulder straps connect the front and back carrying compartments together at an upper portion thereof, and adjustable side straps connect the front and back carrying compartments together at side portions thereof. The pocket is accessible from an exposed portion of the front carrying compartment having a space capable of receiving a handgun, and a flap to seal the pocket and conceal the handgun within the pocket. The pocket may additionally have an internal holster capable of receiving a barrel of the handgun.

In a preferred embodiment of the invention, the pocket is substantially centered on the front carrying compartment. A finger loop would extend from an end portion of the flap, enabling the flap to be rapidly manipulated by the wearer to unseal the pocket for rapid removal of the handgun by pulling downward on the finger loop. To provide a supplemental level of security, an additional panel of the ballistic fabric material may be disposed within the flap. A trauma plate may be further secured within the front carrying compartment to provide even greater security to the wearer.

A more complete understanding of the ballistic panel carrier having a pocket for a backup gun will be afforded to those skilled in the art, as well as a realization of additional advantages and objects thereof, by consideration of the following detailed description of the preferred embodiment. Reference will be made to the appended sheets of drawings which will be first described briefly.

DETAILED DESCRIPTION OF THE PREFERRED EMBODIMENT

The present invention provides an overall safety enhancing apparatus for use by law enforcement personnel which enables a law enforcement officer to conceal a backup gun so that it is readily accessible for use during an emergency situation, while also providing a comfortable ballistic panel carrier.

Figure 1:
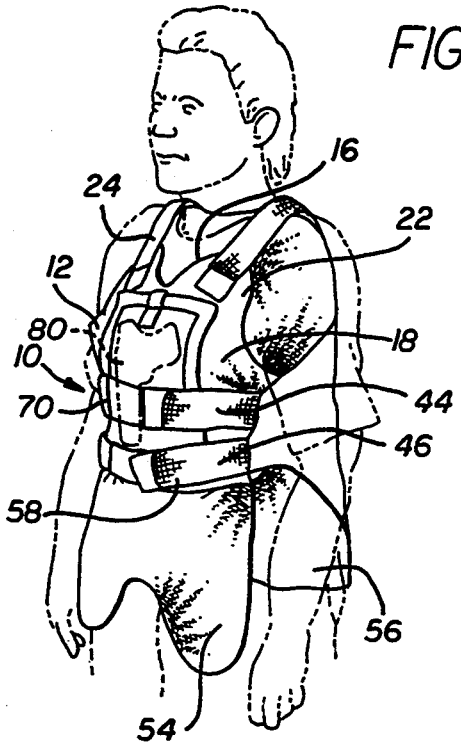
FIG. 1 is a perspective view of the ballistic panel carrier of the present invention as worn by a typical law enforcement officer.
Figure 4:
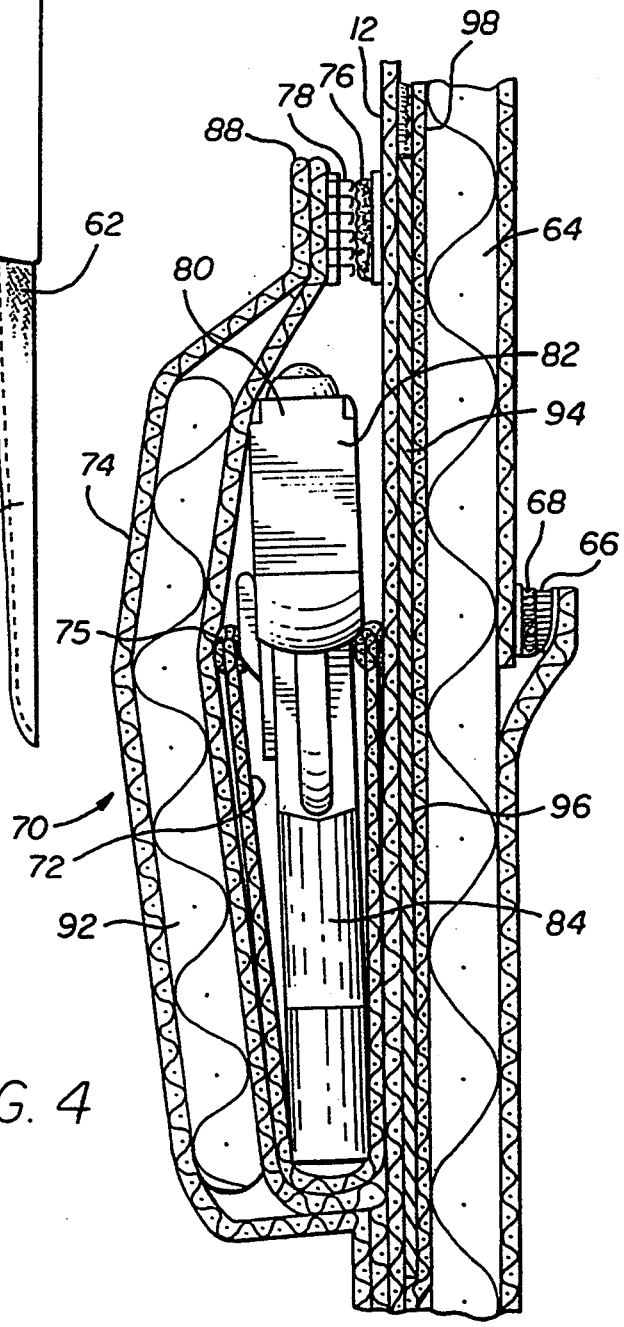
FIG. 4 is a partial sectional side view of the front carrying compartment of the ballistic panel carrier as taken through the section 4—4 of FIG. 3.

Referring first to FIG. 1, a ballistic panel carrier 10 of the present invention is illustrated as worn by a typical law enforcement officer. The carrier 10 includes a front compartment 12 and a back compartment 14, each of which having an internal space for carrying a panel of ballistic fabric material 64. It is anticipated that the panel 64 comprise a standard issue bullet proof vest, however the panel may also be specifically made for use with the carrier 10. The ballistic fabric material may be KEVLAR, or other like puncture resistant material. As illustrated in FIG. 4, the inner portion of the front and back compartments 12 and 14 facing the wearer features an opening 65 which permits the panel 64 to be inserted into the respective compartments. In the preferred embodiment, the opening 65 is sealed by VELCRO portions 66 and 68, although it should be apparent that alternative fastening devices can be used.

The front and back compartments 12 and 14 may be formed of a lightweight cloth material, such as a combination of cotton and polyester. This material would be comfortable to the wearer, easy to clean, resistant to tearing, and could be manufactured in a variety of sizes and colors. A wearer may periodically remove the panels 64 so that the carrier 10 may be cleaned.

Figure 2:
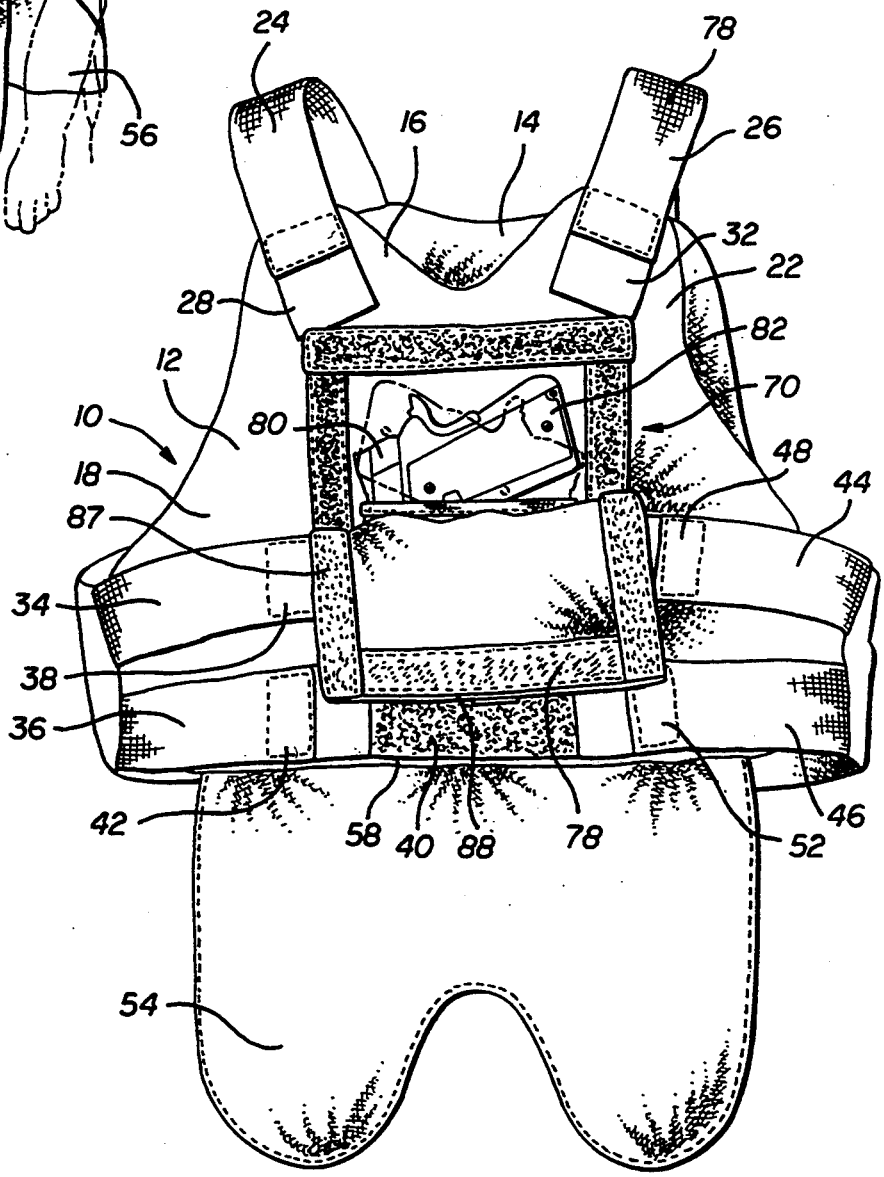
FIG. 2 is a front view of the ballistic panel carrier, illustrating the pocket flap in the fully open position.

The front and back compartments 12 and 14 have shapes somewhat similar to that of the panels 64 of the standard issue vest, which is conducive to protecting the vital areas of the wearer's upper torso. In particular, the front and back compartments 12 and 14 have a generally narrower upper torso portion 22, and a somewhat wider lower torso portion 18, as best illustrated in FIG. 2. The front compartment 12 has a low cut neck portion 16 which provides comfort to the wearer and prevents undesired exposure of the carrier 10 when worn with an open-collared uniform shirt. The back compartment 14 has substantially the same shape as the front compartment 12, except for the low cut neck portion 16 that would be unnecessary for use with the back compartment 14. The carrier 10 further includes front tails 54 extending from a lower edge 58 of the front compartment 12, and back tails 56 extending from a lower edge 62 of the back compartment 14. The tails permit the carrier 10 to be tucked into the wearer's trousers, so as to prevent the vest from riding up the wearer's torso during use.

The carrier 10 is secured to the wearer by use of left and right shoulder straps 24 and 26, and left and right body straps 34, 36, 44 and 46. Each of the straps may be formed of a generally elastic cloth material to permit a generally snug fit of the carrier 10 to the wearer. The carrier 10 would be most effective if worn under the officer's shirt, as an undergarment. The shoulder straps 24 and 26 extend in parallel between the uppermost ends of the upper torso portions 22 of the front and back compartments 12 and 14. Adjustment of the lengths of the shoulder straps 24 and 26 can be made by altering the placement of the attachment points 28 and 32 at the ends of the straps relative to the front compartment 12. Attachment of the attachment points to the front compartment 12 can be achieved through the use of various fastening devices, such as VELCRO, or conventional snaps and buttons. Similar attachment points may also be disposed at the other ends of the straps 24 and 26 for adjustment of the position of the back compartment 14.

The side straps include upper left strap 34, lower left strap 36, upper right strap 44, and lower right strap 46. The side straps join the front and rear compartments 12 and 14 at the sides of the lower torso portion 18. Adjustment to the lengths of the side straps 34, 36, 44 and 46 can be made by altering the placement of the attachment points 38, 42, 48 and 52, respectively, at the ends of the straps relative to the center of the lower torso portion 18. FIG. 2 illustrates the use of a common VELCRO portion 40 disposed axially with the straps 36 and 46 to enable a variety of attachment positions. As described above, attachment of the straps can also be achieved through the use of various fastening devices, such as conventional snaps and buttons.

The carrier 10 can be comfortably fitted to the wearer's body by adjusting the shoulder and body straps to obtain a generally snug fit. The front and rear tails 54 and 56 can be further tucked into the wearer's trousers, so as to maintain the lower portion of the carrier 10 in a proper position. With the wearer's uniform shirt worn over the carrier, the carrier would be completely concealed from view, and an assailant would not know of the existence of the carrier or the internal vest panels. To further improve the comfort and fit of the carrier 10, it is anticipated that the carrier be manufactured in a variety of sizes.

Figure 3:
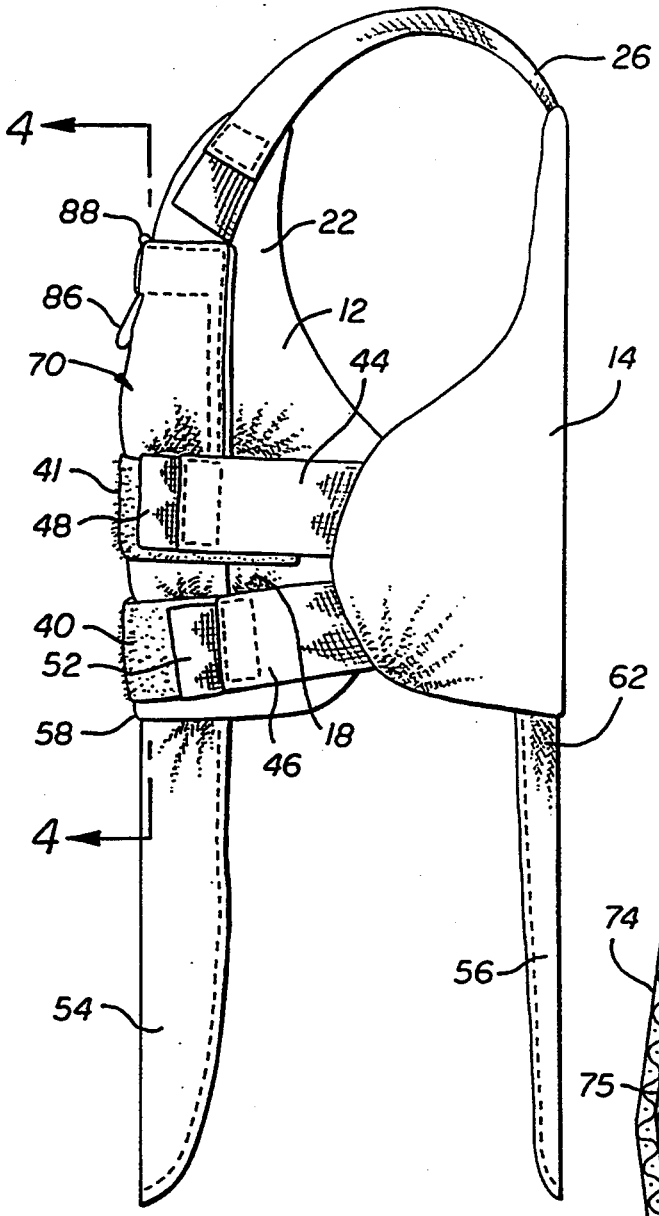
FIG. 3 is a side view of the ballistic panel carrier, illustrating the pocket flap in the sealed position.

To conceal the backup gun, a pocket 70 is disposed in a central portion of the exposed outer surface of the front compartment 12. The pocket 70 is formed by a generally rectangular flap 74 which is secured to the front compartment 12 at a lower portion of the flap, and is generally free from the front compartment at an upper portion of the flap. A fastener, such as VELCRO, is utilized at the top 88 and side edges 87 of the flap 74 to secure it in a sealed position relative to the pocket 70, as illustrated in FIG. 3.

The pocket 70 further includes an inner holster 72 capable of receiving a barrel 84 of a handgun 80. The holster 72 is symmetrically shaped with an opening 75 at a top portion so that the handgun 80 can be positioned in either a left facing or right facing direction, as shown in FIG. 2. This permits the wearer to position the gun in a desired direction such that it would be most readily grasped by the free hand of the wearer. The inner holster 72 prevents the handgun 80 from moving around unnecessarily within the pocket 70 due to normal movement of the wearer. With the flap 74 in the upright, sealed position, the shape of the gun 80 would be generally obscured, and with a uniform shirt worn over the carrier 10, it would be virtually impossible for an assailant to recognize that a gun is so positioned. The flap 74 may additionally have a finger loop 86 extending from the upper edge 88. The finger loop 86 may be formed of a high strength cloth material which would be capable of withstanding repeated hard pulling. The pocket 70 would be large enough to hold additional items, such as spare clips for the handgun 80, in addition to the gun itself.

To provide additional security to the wearer, the flap 74 can be further enhanced with an additional ballistic panel 92. The additional panel 92 could be sewn directly into the flap 74, or an opening similar to that on the interior portion of the compartments for inserting the panels 64 can be provided in the flap for insertion of the panel 92. This ballistic panel 92 would help prevent possible damage to the handgun 80 in the event that a projectile strikes the wearer in the center of the carrier 10.

As an additional security measure, a trauma plate 94 can be inserted into the front compartment 12 behind the pocket 70. The trauma plate 94 may be manufactured of a high strength material, such as steel. The trauma plate 94 would enhance the protective capability of the carrier 10 to the wearer, and additionally guard against possible injury from external projectiles. The interior of the front compartment 12 would have a trauma plate pocket 96 which seals at a top portion 98 with VELCRO or other such fastening device. The wearer could simply slide the trauma plate 94 into the pocket 98 prior to inserting the ballistic panel 64 into the front compartment 12.

In normal use, the carrier 10 would be worn below the uniform shirt, and the wearer would place the backup gun 80 in the pocket 70. During an emergency situation in which the wearer requires access to the gun, the wearer reaches through the shirt opening and grasps the finger loop 86. A downward pull on the finger loop 86 causes the flap 74 to unseal the pocket 70, providing access to the backup gun 80. The wearer can then rapidly remove the backup gun 80, and put it to effective use against the assailant.

Having thus described a preferred embodiment of a ballistic panel carrier having a pocket for concealing a handgun, it should now be apparent to those skilled in the art that the aforestated objects and advantages for the within system have been achieved. It should also be appreciated by those skilled in the art that various modifications, adaptations and alternative embodiments thereof may be made within the scope and spirit of the present invention. For example, the carrier could be advantageously utilized by persons other than law enforcement personnel, such as by military members, security guards and others that would be likely to benefit from the advantages of the present invention. It is further anticipated that alternative ballistic fabric materials, besides KEVLAR, be utilized as such materials become commercially available.

The invention is further defined by the following claims:

What is claimed is:

1. A concealable ballistic panel carrier of the type typically worn under a wearer's shirt for use with front and back torso panels of a ballistic fabric material, the carrier comprising:

a front and a back carrying compartment to contain the front and back torso panels, respectively, adjustable shoulder straps connecting said front and back carrying compartments together at an upper portion thereof, and adjustable side straps connecting said front and back carrying compartments together at side portions thereof; and a pocket comprising a front panel having an upper portion and a lower portion secured to said from carrying compartment and accessible from an exposed area thereof, said pocket sized and shaped for holding a holster therein and having an opening defined between said front panel and said front carrying compartment for receiving said holster, said lower portion of said panel having peripheral surrounding edges secured to said front carrying compartment, said upper portion of said panel defining a flap extending upwardly from said lower portion and having surrounding peripheral edges adapted to sealably engage a top portion of said front carrying compartment to deny access to said opening wherein said holster, when placed in said pocket, is exposed upon intentional unsealing of said sealable edges from said top portion of said front carrying compartment.

2. The carrier of claim 1, wherein said pocket is substantially centrally disposed on said front carrying compartment.

3. The carrier of claim 1, further comprising means for removably sealing said peripheral edges of said upper portion of said panel to said top portion of said front carrying compartment.

4. The carrier of claim 3, further comprising a finger loop affixed to one of said peripheral edges of said upper portion, whereby said edges of said upper portion are adapted to be rapidly manipulated to unseal said edges of said upper portion from said top portion for access to said holster by pulling said finger loop.

5. The carrier of claim 1, further comprising a trauma plate disposed within said front carrying compartment.

6. The carrier of claim 5, further comprising means for receiving said trauma plate within said front carrying compartment.

7. The carrier of claim 1, further comprising tails extending downwardly from a lower edge portion of the front and the back carrying compartments.

8. A concealable ballistic panel carrier of the type typically worn under a wearer's shirt having at least one torso panel of a ballistic fabric material, the carrier comprising:

a carrying compartment to contain said at least one torso panel;

means connected to said compartment for securing said compartment about the upper torso of the wearer; and a pocket comprising a front panel having an upper portion and a lower portion secured to said carrying compartment and accessible from an exposed area thereof, said pocket sized and shaped for holding a holster therein and having an opening defined between said front panel and said carrying compartment for receiving said holster, said lower portion of said panel having peripheral surrounding edges secured to said carrying compartment, said upper portion of said panel defining a flap extending upwardly from said lower portion and having surrounding peripheral edges adapted to sealably engage a top portion of said front carrying compartment to deny access to said opening wherein said holster, when placed in said pocket, is exposed upon intentional unsealing of said sealable edges from said top portion of said carrying compartment.

9. The carrier of claim 8, said means for securing comprising adjustable straps.

10. The carrier of claim 8, wherein said carrying compartment includes a front carrying compartment, and said pocket is substantially centrally disposed on said front carrying compartment.

11. The carrier of claim 8, wherein said flap comprises an internal cavity wherein a ballistic panel is inserted therein.

* * * * *